United States Patent [19]

Jones

[11] 4,402,506

[45] Sep. 6, 1983

[54] BODY-EXERCISE DEVICE

[76] Inventor: William C. Jones, Box 154, St. Cloud, Minn. 56301

[21] Appl. No.: 195,773

[22] Filed: Oct. 10, 1980

[51] Int. Cl.[3] ..... A63B 21/22

[52] U.S. Cl. ..... 272/132; 272/97; 272/DIG. 4; 272/70; 273/DIG. 8

[58] Field of Search ..... 272/70, 70.3, 131, 134, 272/DIG. 3, 97, 128; 434/255

[56] References Cited

U.S. PATENT DOCUMENTS

| | | | |
|---|---|---|---|
| 1,982,843 | 12/1934 | Traver | 272/70 |
| 2,021,801 | 11/1935 | Meyer | 272/70 |
| 3,559,986 | 2/1971 | Ehrmantraut | 272/97X |

*Primary Examiner*—Richard C. Pinkham

*Assistant Examiner*—William R. Browne

*Attorney, Agent, or Firm*—Dorsey & Whitney

[57] ABSTRACT

An improved body-exercising device has a pair of dollies supported for movement along two guideways and permits a user to stand with one foot on each dolly and laterally separate the dollies to exercise the body. Foam pads are affixed to the dollies to receive the user's feet and to afford the freedom of movement necessary to the exercise while also affording control of the dolly. The device further includes an adjustable connection fixing the distance between the guideways and preventing their lateral movement. A compressible rolling surface may be provided on the guideways for use with rollable dollies to increase the rolling resistance encountered by the dollies.

8 Claims, 14 Drawing Figures

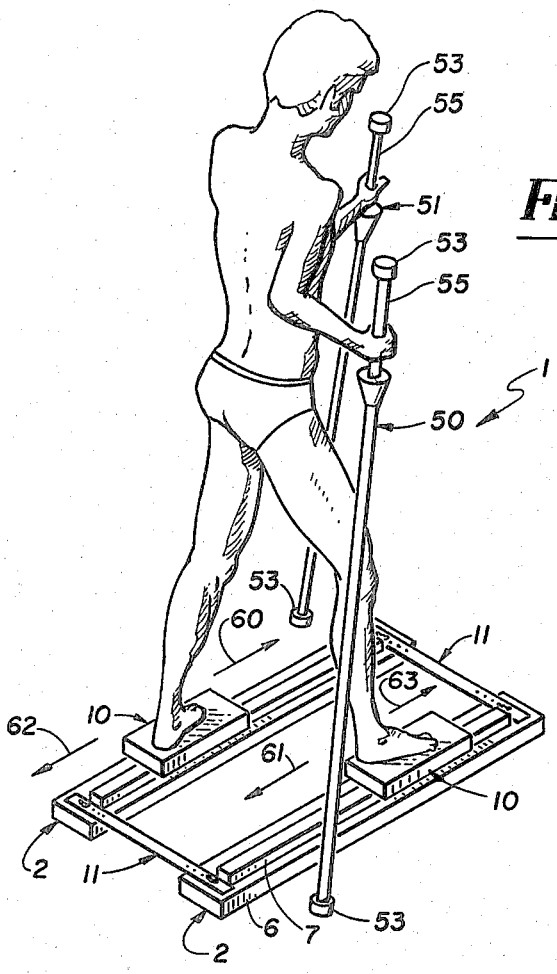
Fig.1
Fig.2B
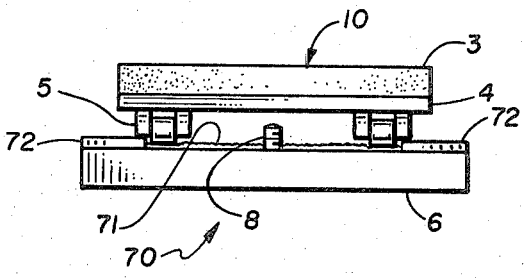
Fig.4
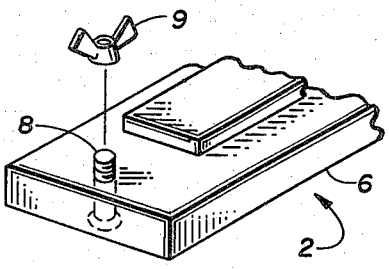
Fig.2
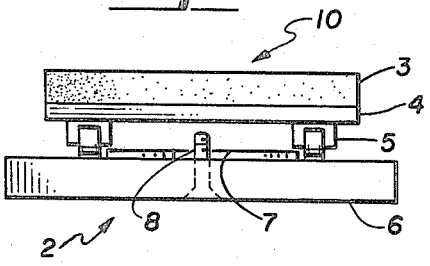
Fig.3
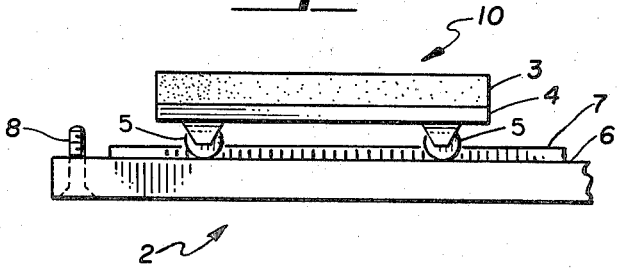
Fig.2A
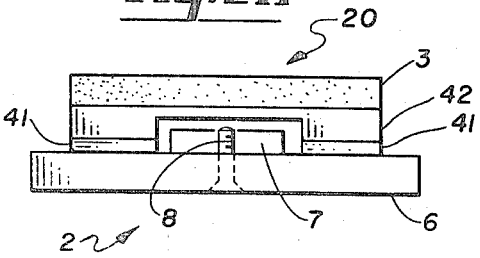
Fig.3A
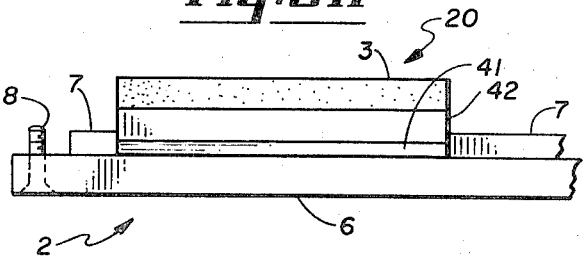

BODY-EXERCISE DEVICE

BACKGROUND OF THE INVENTION

1. Field of the Invention

This invention relates generally to an improvement of body exercise devices utilizing dollies supported for movement along guideways so that a person standing on such dollies exercises by moving his feet in opposite directions and returning them to the original position or by simulating the leg movement peculiar to cross-country skiing.

2. Description of the Prior Art

Various types of exercise devices involving dollies and guideways have been developed in the prior art. Such devices allow the body, particularly the legs, to move in simple, natural rhythmic motion. The long, flowing movement of the legs gives exercise to the entire lower body, with particular benefit to the thighs, hips, waist, and buttocks. By using hand-held balancing poles in conjunction with the dollies, the upper body, including arms, shoulders, chest, and back, is firmed and strengthened.

Some prior art devices have been designed such that the user's entire foot, both heel and toe, is firmly restrained on the dolly. Such an arrangement does not allow the full freedom of movement of the foot desirable for such exercise. Other prior art devices incorporate a shoe hinged at the toe, such as with a cross-country ski shoe. While allowing greater freedom of movement, the latter arrangement is often complex in structure and costly. In addition, there may be inconvenience involved in fastening the straps or other attachment devices which hold the foot. In still other prior art devices, the user's foot rests by friction and the force of gravity on a dolly having a hard rubber tread, e.g. Ehrmantraut U.S. Pat. No. 3,559,986. Such an arrangement, while allowing the necessary freedom of movement of the foot, results in less control of the dolly than the earlier discussed arrangements. It may also be uncomfortable or otherwise unsuitable for use with bare feet.

Prior art exercise devices involving dollies without guideways can also be unsatisfactory, because, as the feet move in opposite directions during the exercise, the dollies can collide or, alternatively, progressively move an uncomfortable distance apart during exercise. Adding guideways to such devices is an improvement that prevents such collisions, but it may not serve to maintain the dollies at a comfortable distance apart, because the guideways themselves may move apart. The user's weight is roughly centered between the two guideways. Thus, the natural movements of a user exercising will often create a force perpendicular to the length of the guideways that tends to push the guideways apart.

SUMMARY OF THE INVENTION

The present invention provides a pair of movable dollies, each with a substantially compressible pad attached thereon, adapted to securely receive a foot of a person standing thereon, such dollies being movably disposed on guideways which are adjustably connected to one another to fix the distance between them. Thus, the invention is primarily adapted for exercise consisting of backward and forward separation of a user's two feet while standing on the movable dollies. To intensify the exercise when rollable dollies are used, a compressible rolling surface may be provided as part of the upper surface of the guideways. There may be further provided a pair of balancing poles, serving to facilitate certain movements of the legs and the rest of the body, such as in cross-country skiing, by shifting part of the user's weight to the balancing poles.

It is a primary object of this invention to provide an improved body-exercise device. It is another object of this invention to provide an improved body-exercise device incorporating substantially compressible pads on dollies that provide the necessary freedom of movement and requisite coantrol of the dolly in a simple and inexpensive manner. It is a further object of this invention to provide an improved body-exercise device incorporating adjustable connection means between the guideways that adjustably fixed the distance between the guideways in a simple and inexpensive manner. It is a still further object of the invention to provide an improved body exercise device using dollies with means for supporting and holding the user's feet which are comfortable and require no fastening or adjustment. It is a still further object of the invention to provide a body-exercise device which can be used on any surface. It is still a further object of the invention to provide a body-exercise device with guideways having a compressible rolling surface thereon which interacts with rolling dollies to provide rolling resistance against the dollies during their movement.

These and other objects of the invention will become apparent from a study of the following description of the preferred embodiments and the following figures.

BRIEF DESCRIPTION OF THE DRAWINGS

FIG. 1 is a perspective view showing an exercising device according to the present invention as it would be used;

FIG. 2 is an end view of a rollable dolly as used in the invention situated on a guideway;

FIG. 2A is an end view of a slidable dolly, an alternative embodiment of the rollable dolly of FIG. 2, situated on a guideway;

FIG. 2B is an end view of a rollable dolly as used in the invention, situated on an alternative embodiment of a guideway which has a compressible rolling surface and exterior guide rails;

FIG. 3 is a side view of a rollable dolly as used in the invention situated on a guideway;

FIG. 3A is a side view of a slidable dolly, an alternate embodiment of the rollable dolly of FIG. 3, situated on a guideway;

FIG. 4 is a perspective view of a guideway showing a vertical threaded bolt projecting through the guideway and with its unattached but matching wing nut;

DESCRIPTION OF THE PREFERRED EMBODIMENTS

Figure 5:
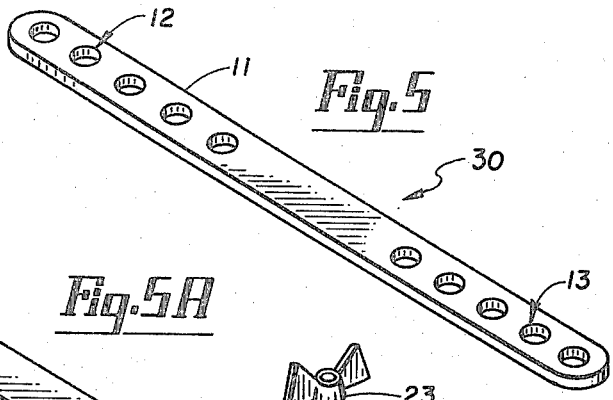
FIG. 5 is a top view of a metal strip connector for connecting a pair of guideways, having a plurality of bores for receiving the bolt represented in FIG. 4.

The body-exercise device of the present invention, as shown in FIG. 1, consists generally of a pair of guideways 2,2 on which a pair of movable dollies 10, 10 are mounted. The distance between the guideways 2, 2 is adjustably fixed by connecting means 11 at either end. The device can be used with or without a pair of balancing poles 50, 51.

As shown in FIG. 1, each guideway 2 includes a flat, rectangular base 6 adapted to support the rollers 5 of a rollable dolly 10 (FIGS. 2, 3) or the sliding surfaces 41 of a slidable dolly 20 (FIGS. 2A, 3A). Each guideway 2 further includes a guide rail 7, centered between the edges of the base 6 and running longitudinally thereon, and adapted to guide the dollies 10 or 20. The base 6 and rail 7 of each guideway 2 can be made of any suitable wood, plastic or metal material. In the preferred embodiment, both are made of plywood. The width of the rail 7 is slightly less than the distance between the wheels 5; the width of the base 6 is sufficient to carry the wheels 5 with no danger of them falling off to the side. The length of the base is sufficient to accommodate a long stride of approximately five to six feet.

An alternative embodiment of a guideway 70 for use with a rollable dolly 10 is shown in FIG. 2B. In this embodiment, the guideway 70 has a pair of exterior guide rails 72, 72, formed by narrow wood or metal strips placed along the edges of the base 6, rather than the single center guide rail 7 shown in FIGS. 2, 2A. In addition, in this embodiment the upper surface of the guideway 70 is covered with a rolling surface 71 which is comprised of a thin layer of a substantially compressible material which has a wear resistant upper surface and which is attached by adhesive or other suitable means to the upper surface of the base 6. Suitable materials for the rolling surface 71 include commercially available cushioned linoleum-type floor coverings or rubber or urethane foam matting having a wear surface, such as a vinyl film, laminated on one side, such as Airtex Floortile Matting manufactured by Airtex Industries, Inc. of Minneapolis, Minn. The preferred thickness of the rolling surface is $\frac{1}{8}$ to $\frac{1}{2}$ inch, depending on its compressibility and the amount of rolling resistance desired. Because the rollers 5 of the rollable dolly 10 sink into the rolling surface 71, the effort required to move each dolly 10 is increased, thus providing more intensive exercise. Also, the rolling surface 71 provides the user with somewhat greater control over a dolly 10 having free-running wheels. The amount of rolling resistance will vary according to the weight placed on the dolly 10 and the extent to which the rollers 5 sink into the resistance rolling surface; thus, resistance can be varied somewhat by the user by shifting body weight.

Each guideway 2, as shown in FIG. 4, further includes a projection 8 at each of its ends, each projection comprising, in the preferred embodiment, a threaded bolt which extends upward through the base 6. The head of the projection 8 does not protrude from the lower surface of the base 6, leaving the lower surface substantially flat and suitable for use on any surface, whether carpet, hardwood or linoleum.

Figure 6:
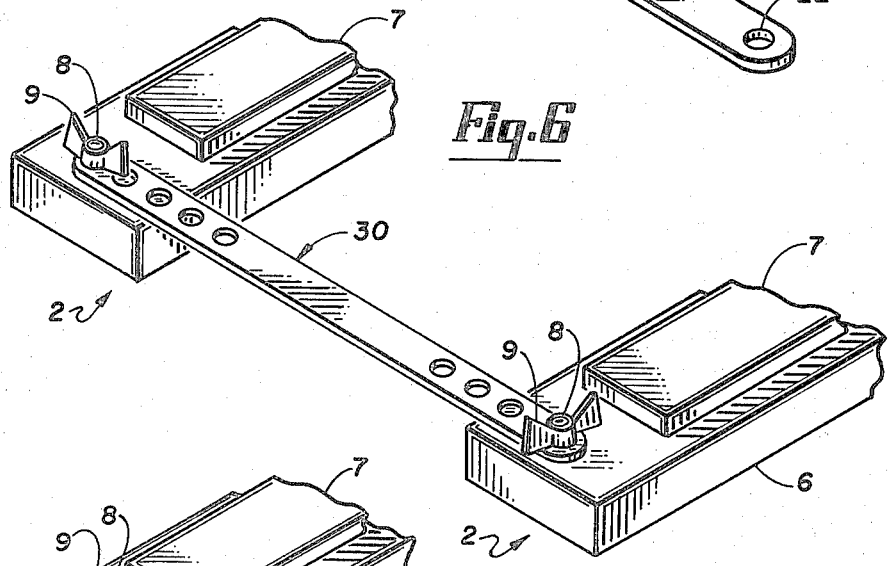
FIG. 6 is a perspective view of the metal strip in FIG. 5 attached to two guideways, fixing the distance between those guideways.

Two guideways 2,2 are connected together to form a substantially parallel pair of guideways, as best seen in FIG. 1, by a suitable connecting means for adjustably fixing the distance between them. As shown in FIGS. 5, 6, the preferred embodiment includes a substantially rigid metal strip 30 having a plurality of bores 12, 13 at each end for receiving the projecting ends of bolts 8. The distance between the two guideways 2,2 is adjustably fixed by tightening wing nuts 9 upon the projecting ends of bolts 8 after inserting the bolt ends in two suitably-spaced bores of the plurality of bores 12, 13. Rotational movement of the ends of the strip 30 relative to the base 6 may be prevented by locating each bolt 8 close to the end of the rail 7, such that the edge of the strip 30 rests against the end of the rail 7 (not shown).

Figure 5A:
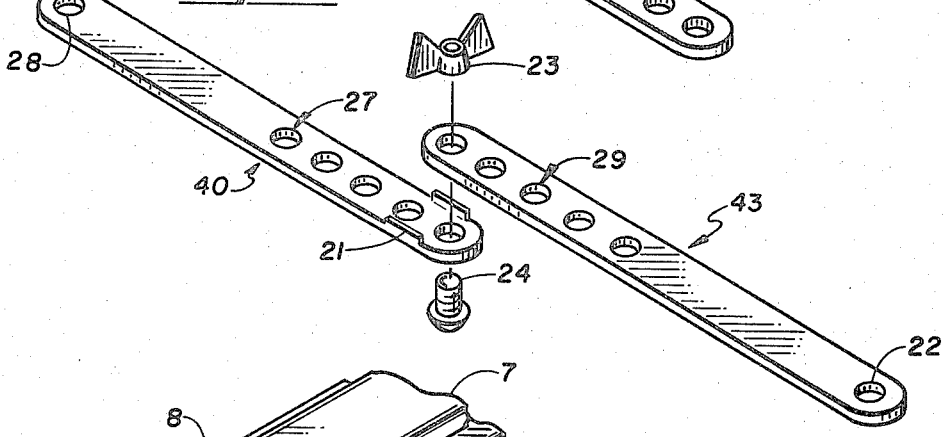
FIG. 5A is an exploded view of an adjustable connector for connecting a pair of guideways, comprising two metal strips, a threaded bolt, and a matching wing nut, an alternative embodiment of the connecting means of FIGS. 4, 5.
Figure 6A:
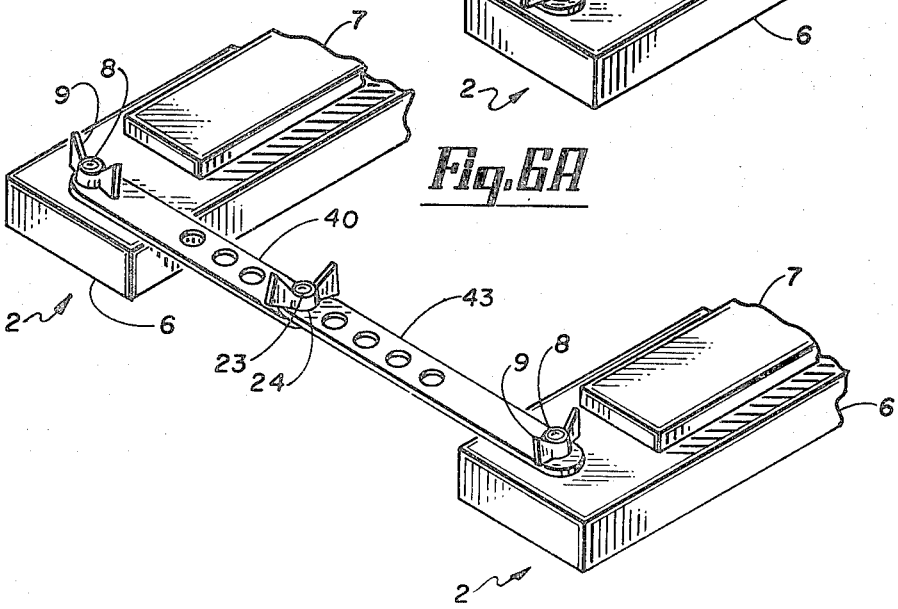
FIG. 6A is a perspective view of the connector in FIG. 5A attached to two guideways, fixing the distance between those guideways, an alternative embodiment to that of FIG. 6.

As shown in FIGS. 5A and 6A, in an alternative embodiment, the connecting means can have a single bore at each end, by making it of adjustable length. In this embodiment, the distance between the two guideways 2,2 is adjustably fixed by tightening one wing nut 9 on the projecting end of bolt 8 of one guideway 2 when that bolt 8 is received by bore 28 in one end of a metal strip 40, tightening a second wing nut 9 on the projecting end of bolt 8 of the other guideway 2 when that bolt is received by bore 22 in one end of a second metal strip 43, and tightening third wing nut 23 on bolt 24 when that bolt is received by one of the plurality of bores 27 in the other end of metal strip 40 and one of the plurality of bores 29 in the other end of metal strip 43. A pair of flanges 21 adjacent the plurality of bores 27 of one metal strip 40 can be used to prevent rotation of one strip 40 relative to the other strip 43 when the strips are bolted together.

Each rollable dolly 10 comprises a substantially flat platform 4 of wood, metal, plastic or other suitable material, with rollers 5 attached to the underside and a layer of urethane or rubber foam 3 attached to the upper side, as shown in FIGS. 2 and 3. Each slideable dolly 20 similarly comprises a sliding platform 42 with a cross-section in the form of an inverted "U" and sliding surfaces 41 on the underside, and a layer of urethane or rubber foam 3, as shown in FIGS. 2A and 3A. The sliding surfaces may be bare, waxed wood or covered with a thin layer of vinyl film or with a brushlike material having short bristles. The thickness of the layer of urethane foam 3 can vary significantly, but in the preferred embodiment it is approximately one inch thick. The configuration of the foam 3 can also vary, as, for example, by contouring it somewhat to the foot, but in the preferred embodiment it is substantially flat.

To achieve comfort and sufficient foot holding, the type and density of the foam used to form the foam layer 3 is carefully selected. In the preferred embodiment a urethane foam is used having a density in the range from 1.8 lbs. to 2.2 lbs. per cubic foot, although foams in the range form 0.5 to 6 lbs. per cubic foot could be used. For users of greater body weight a higher density foam within the suitable range will be selected; for users with lower body weight, such as children, a lower density foam within the range will be selected.

Each of a pair of balancing poles 50, 51 as shown in FIG. 1, comprises a wooden staff 55, being of suitable length and diameter to be grasped comfortably by a human hand, with rubber end caps 53 at both the top and the bottom provided for traction and safety. Poles 55 can also be constructed of bamboo, aluminum or other metals or materials of suitable strength and weight, and may be hollow or solid. They may also be provided with hand grips and straps (not shown) as with ski poles.

To set up the exercise device of the present invention, the user merely places a pair of guideways 2,2 (or 70,70, referring to the embodiment of FIG. 2B) on a carpeted floor or other surface at a comfortable distance apart. By using the connection means of FIGS. 4, 5, 6 or the alternative embodiment of FIGS. 5A, 6A, the guideways 2,2 are held in place against both lateral and longitudinal movement. The rollable dollies 10 (or slideable dollies 20) are placed on the bases 6 astride the guides 7. The user then merely steps on to the compressible pads 3 and exercise may begin, with or without the balance poles 50, 51.

Vigorously working the two dollies 10, or alternatively the two dollies 20, as shown in FIG. 1, by moving one leg in direction 60 while the other leg moves in direction 61 and then moving the one leg in direction 62 while the other leg moves in direction 63, will exercise a person's lower body. A person's upper body will be exercised if the person places some of his or her weight upon the balancing poles 50, 51. Also placing weight on the balancing poles 50, 51 will assist in varying the amount of rolling resistance encountered by the dollies 10 when the guideway 70 having a compressible rolling surface 71 is used.

Because dollies 10, 20 are readily removable from the guideways 2 and because the two guideways are readily separable, the body-exercising device can be easily and compactly stored in a closet or other suitable place between uses.

Figure 7:
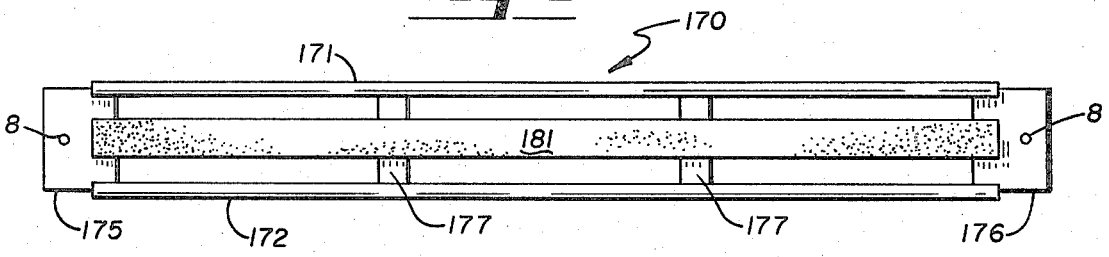
FIG. 7 is a plan view of an alternative embodiment of a guideway having tubular guide rails and a center-mounted compressible rolling surface.
Figure 8:
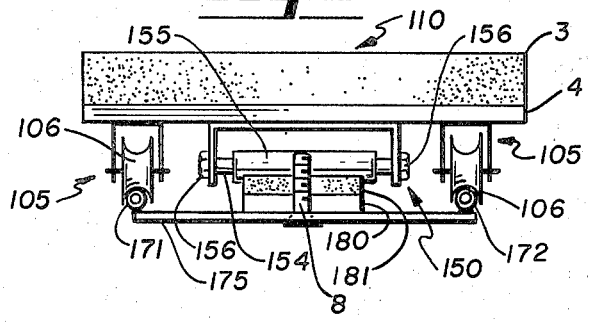
FIG. 8 is an end view of an alternate embodiment of a rollable dolly as used with the guideway of FIG. 7.
Figure 9:
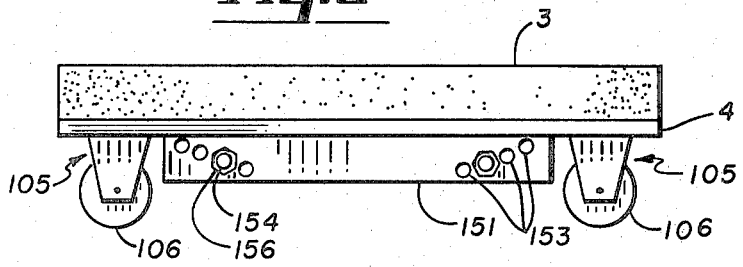
FIG. 9 is a side view of the alternate embodiment of a rollable dolly as shown in FIG. 8.

A further alternate embodiment of the invention is shown in FIGS. 7, 8 and 9. In this embodiment, each guideway 170 is constructed, as best seen in FIGS. 7 and 8, with two exterior tubular rails 171, 172, made, in the preferred embodiment, from metal conduit or pipe approximately one inch in diameter and five to six feet in length. The rails 171, 172 are held in parallel position by two end brackets 175, 176, one located at each end. Additional brackets 177 may be located at intervals between the two end brackets 175, 176 to provide additional strength. The various brackets 175, 176, 177 may be welded or bolted or attached by other suitable means (not shown) to the underside of the rails 171, 172 so that the sides and tops of the rails 171, 172 are clear of any interruptions of their circular cross-section. The end brackets 175, 176 are provided with upwardly projecting bolts 8 with matching wing nuts 9 (not shown) so that they can be used with the same connecting means as is shown in FIGS. 5, 5A, 6 and 6A.

An alternative embodiment of a rollable dolly as used with the guideway 170 is shown in FIG. 8 as it would appear on such a guideway. This rollable dolly 110 has a flat platform 4 and a layer of urethane or rubber foam 3 attached to the upper side as in previously-described rollable dolly embodiments. In this embodiment, however, the paired rollers 105 do not have flat-surfaced wheels, but rather wheels 106, 106 with a concave surface adapted to roll on the tubular rails 171, 172. Accordingly, the center line of each pair of wheels 106, 106 is aligned with the longitudinal axes of the tubular rails 171, 172.

A further feature of this embodiment of the invention can be seen in FIGS. 7 and 8. In this embodiment, the wheels 106 roll freely on the tubular rails 171, 172, so that if rolling resistance is to be provided to intensify exercise, a compressible rolling surface under the rollers 105 (as proposed in FIG. 2B) is unsuitable. Instead, a compressible rolling surface is affixed to a flat rail 180, made of wood, metal or other suitable material, which runs midway between and parallel to the tubular rails 171, 172. The upper surface of the rail 180 is covered with a compressible rolling surface 181 similar to the surface 71 shown in FIG. 2B and described in connection therewith. In the embodiment of FIG. 8, the rolling surface 181 is somewhat thicker than that shown in FIG. 2B, typically one-half inch to one-inch of a compressible urethane or rubber foam with a wear resistant upper surface.

Contact between the rollable dolly 110 and the rolling surface 181 is established by a resistance roller assembly 150 mounted on the underside of the platform 4 of the rollable dolly 110. The resistance roller assembly 150 comprises a channel 151 made of thin, rigid metal plate bent in the shape of an inverted "U", having a width somewhat greater than the width of the flat rail 180 and rolling surface 181. Referring now also to FIG. 9, it is seen that channel 151 has a plurality of paired holes 153 at each end, with some holes 153 located closer to the platform 4 than others. At each end of the channel 151, an axle 154 with nuts or other suitable fasteners 156 at each end passes through a roller tube 155, made of metal or plastic tubing of approximately one-half inch outside diameter, and through a set of paired holes 153. Depending on which set of paired holes 153 is used, the roller tube 155 bears heavily or lightly against the compressible rolling surface 181. By choosing a pair of holes 153 closer or farther away from the platform 4, the same compressible rolling surface 181 can produce various degrees of rolling resistance, depending on the preference of the user.

The embodiment of the invention shown in FIGS. 7, 8 and 9 is used in the same manner as the previously-described embodiments. That is, the guideways are fastened a comfortable distance apart by the connection means of FIGS. 4, 5, 6 or 5A, 6A and the user, after placing the dollies 110 onto the rails 171, 172, steps onto the compressible pads 3 to begin exercise. Should the user wish to increase or decrease the resistance encountered during movement of the dollies 110, the axles 154 can be moved to different sets of paired holes 153, to increase or decrease the pressure of the roller tubes 155 against the rolling surface 181 of each guideway 170.

The above description of the preferred embodiments is somewhat specific. Those skilled in the art will perceive modifications which can be made in the preferred embodiment without departing from the spirit of the invention. For example, although the invention has been described primarily with reference to urethane or rubber foam as the material used for the substantially compressible pad and with reference to metal strips in conjunction with bolts and wing nuts used to form the connection between the two guideways, it is clear that other materials and connectors could work as well in the invention. The compressible rolling surfaces 71, 181 could also be made from materials other than the specific types mentioned above. Further, it is clear that the compressible rolling surface 71 could be placed on a rigid backing, such as a thin metal plate, and, with suitable means for fastening to the base 6, made as a replaceable upper surface for the guideway 70. This would permit substitution of various rolling surfaces having different compressibility characteristics and thus offering different resistances to the rolling of the dollies 10.

Accordingly, the appended claims are intended to cover all such embodiments and operations according to the true spirit and scope of the invention.

I claim:

1. An improved body-exercising device of the type having a pair of rollably supported dollies and two substantially parallel guideway means, each guideway means cooperating with one of said dollies for supporting and guiding the dolly, wherein the improvement comprises:

(a) two substantially compressible pads, one pad attached to each of said pair of dollies, each of said pads adapted to securely receive one foot of a person standing thereon; and (b) means for adjustably fixing the distance between said substantially parallel guideway means;

and wherein each of said guideway means has at least one projection thereon and said means for adjustably fixing the distance between said guideway means comprises:

(c) at least one substantially rigid connector having a plurality of bores at each of its ends, each bore being adapted to receive one of said projections; and (d) fastening means cooperating with said projections for fixedly securing said projections in said bores.

2. The improved body-exercising device set forth in claim 1, wherein said at least one connector comprises a substantially rigid metal strip having said plurality of bores at each of its ends, said projections comprise threaded bolts, and said locking means comprises wing nuts cooperating with said bolts.

3. An improved body-exercising device of the type having a pair of rollably supported dollies and two substantially parallel guideways means, each guideway means cooperating with one of said dollies for supporting and guiding the dolly, wherein the improvement comprises:

(a) two substantially compressible pads, one pad attached to each of said pair of dollies, each of said pads adapted to securely receive one foot of a person standing thereon; and (b) means for adjustably fixing the distance between said substantially parallel guideway means;

and wherein each of said guideways means has at least one projection thereon and said means for adjustably fixing the distance between said guideway means comprises:

(c) at least one substantially rigid connector of adjustable length having at least one bore at each of its ends for receiving one of said projections; and (d) fastening means cooperating with said projections for fixedly securing said projections when received in said bores.

4. The improved body-exercising device set forth in claim 3, wherein said projections comprise threaded bolts, said locking means comprises wing nuts cooperating with said bolts, and said at least one connector comprises:

(a) a connecting bolt;

(b) a matching fastener for said bolt; and (c) two metal strips, each having a bore for receiving said at least one projection at its one end and a plurality of bores for receiving said connecting bolt at its other end.

5. An improved body exercise device of the type having a pair of movably supported dollies and two substantially parallel guideway means, each guideway means cooperating with one of said dollies for supporting and guiding the dolly, wherein the improvement comprises:

(a) two substantially compressible pads, one pad attached to each of said pair of dollies, each of said pads adapted to securely receive one foot of a person standing thereon; and (b) means for adjustably fixing the distance between said substantially parallel guideway means;

and wherein:

(c) each guideway means comprises a pair of parallel tubular tracks and a center rail located parallel to and between said tracks, said center rail having a layer of substantially compressible material thereon acting as a rolling surface; and (d) each movably supported dolly comprises paired rollers adapted to roll on said tubular tracks and a resistance roller assembly adapted to cooperate with and bear against said layer of substantially compressible material on said center rail, whereby movement of each dolly on said tracks causes said substantially compressible material on said center rail to be compressed.

6. The improved body exercise device set forth in claim 5 wherein said resistance roller assembly is adjustably connected to said moveably supported dolly to vary the extent to which said dolly compresses the substantially compressible material on said center rail.

7. An improved body exercise device of the type having a pair of movably supported dollies and two substantially parallel guideway means, each guideway means cooperating with one of said dollies for supporting and guiding the dolly, wherein the improvement comprises:

(a) two substantially compressible pads, one pad attached to each of said pair of dollies, each of said pads adapted to securely receive one foot of a person standing thereon; and (b) means for adjustably fixing the distance between said substantially parallel guideway means;

and wherein:

(c) each guideway means has a center rail located parallel to and between its longitudinal edges, said center rail having a layer of substantially compressible material thereon acting as a rolling surface; and (d) each movably supported dolly is a rollably supported dolly and also has a resistance roller assembly adapted to cooperate with and bear against said layer of substantially compressible material on said center rail, whereby movement of each dolly on said guideways causes said substantially compressible material on said center rail to be compressed.

8. The improved body exercise device set forth in claim 7 wherein said resistance roller assembly is adjustably connected to said movably supported dolly to vary the extent to which said dolly compresses the substantially compressible material on said center rail.

* * * * *